US009016835B1

(12) United States Patent
Nystrom et al.

(10) Patent No.: US 9,016,835 B1
(45) Date of Patent: Apr. 28, 2015

(54) MEMS ACTUATOR PRESSURE COMPENSATION STRUCTURE FOR DECREASING HUMIDITY

(71) Applicant: Xerox Corporation, Norwalk, CT (US)

(72) Inventors: Peter J. Nystrom, Webster, NY (US); Barry P. Mandel, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 15 days.

(21) Appl. No.: 14/075,027

(22) Filed: Nov. 8, 2013

(51) Int. Cl.
*B41J 2/04* (2006.01)
*B41J 2/045* (2006.01)

(52) U.S. Cl.
CPC ..... *B41J 2/045* (2013.01); *B41J 2002/043* (2013.01)

(58) Field of Classification Search
USPC ..... 347/54
See application file for complete search history.

(56) References Cited

U.S. PATENT DOCUMENTS

| | | | | |
|---|---|---|---|---|
| 4,772,901 | A * | 9/1988 | Boyer et al. | 347/126 |
| 6,126,273 | A * | 10/2000 | Van Vooren et al. | 347/54 |
| 8,083,323 | B2 | 12/2011 | Gulvin et al. | |
| 8,567,911 | B2 | 10/2013 | Nystrom et al. | |
| 2004/0104972 | A1 * | 6/2004 | Silverbrook | 347/54 |
| 2010/0103227 | A1 * | 4/2010 | Desse | 347/74 |
| 2013/0265369 | A1 | 10/2013 | Gerner et al. | |

* cited by examiner

*Primary Examiner* — Stephen Meier
*Assistant Examiner* — Alexander D Shenderov
(74) *Attorney, Agent, or Firm* — MH2 Technology Law Group LLP

(57) ABSTRACT

A printhead including a venting system and an actuator array, wherein each actuator may include an actuator air chamber. The venting system includes an air path that vents each actuator air chamber to the atmosphere. The printhead further includes a dryer configured to remove moisture from air within the air path. The dryer may include a passive desiccant, an active resistive heater, or both.

20 Claims, 3 Drawing Sheets

MEMS ACTUATOR PRESSURE COMPENSATION STRUCTURE FOR DECREASING HUMIDITY

TECHNICAL FIELD

The present teachings relate to the field of ink jet printing devices and, more particularly, to methods and structures for electrostatically actuated ink jet printheads and a printer including an electrostatically actuated ink jet printhead.

BACKGROUND

Drop on demand ink jet technology is widely used in the printing industry. Printers using drop on demand ink jet technology may use a plurality of electrostatic actuators, piezoelectric actuators, or thermal actuators to eject ink from a plurality of nozzles in an aperture plate. In electrostatic ejection, each electrostatic actuator, which is formed on a substrate assembly, typically includes a flexible diaphragm or membrane, an ink chamber between the aperture plate and the membrane, and an air chamber between the membrane and the substrate assembly. An electrostatic actuator further includes an actuator electrode formed on the substrate assembly within the air chamber. When a voltage is applied to activate the actuator electrode, the membrane is drawn toward the electrode by an electric field and actuates from a relaxed state to a flexed state, which increases a volume of the ink chamber and draws ink into the ink chamber from an ink supply or reservoir. When the voltage is removed to deactivate the actuator electrode, the membrane relaxes, the volume within the ink chamber decreases, and ink is ejected from the nozzle in the aperture plate.

The air chamber for each electrostatic actuator across the printhead may be sealed or open to the atmosphere. A vented air chamber is typically preferred so that pressure within the air chamber and the atmosphere are equalized to decrease the effect of changing atmospheric pressure and temperature on the operation of the electrostatic actuators. For example, U.S. Pat. No. 8,567,911, commonly assigned herewith and incorporated herein by reference in its entirety, discloses an electrostatic actuator device having channels that vent the air chamber of each electrostatic actuator to the atmosphere.

Although venting the air channels to atmosphere makes a printhead more robust relative to elevation or air pressure changes, it makes the printhead less robust to changes in humidity since high humidity air entering the printhead changes the air breakdown properties which can impact the operation of the electrostatic actuator. The electrostatic actuators may behave increasingly erratic as humidity increases. An electrostatically actuated ink jet printhead having a more stable operation at changing environmental conditions would be desirable.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

In an embodiment of the present teachings, a printhead may include a plurality of actuators, wherein each actuator includes an actuator air chamber, an actuator electrode, a membrane configured to flex toward the electrode during activation of the electrode, and an actuator ink chamber, wherein the membrane is interposed between the actuator air chamber and the actuator ink chamber. The printhead may further include a venting system comprising an air path that vents each actuator air chamber with an atmosphere, and a dryer positioned within the air path, wherein the dryer is configured to decrease humidity of air within the air path during ejection of ink from the printhead.

In another embodiment, a printer may include a printhead. The printhead may include a plurality of actuators, wherein each actuator includes an actuator air chamber, an actuator electrode, a membrane configured to flex toward the electrode during activation of the electrode, and an actuator ink chamber, wherein the membrane is interposed between the actuator air chamber and the actuator ink chamber. The printer may further include a venting system comprising an air path that vents each actuator air chamber with an atmosphere, a dryer positioned within the air path, wherein the dryer is configured to decrease humidity of air within the air path during ejection of ink from the printhead, and a printer housing that encases the printhead.

In another embodiment, a method for forming a printhead include forming a plurality of actuators, wherein each actuator comprises an actuator air chamber, an actuator electrode, a membrane configured to flex toward the electrode during activation of the electrode, and an actuator ink chamber, wherein the membrane is interposed between the actuator air chamber and the actuator ink chamber. The method may further include forming a venting system comprising an air path that vents each actuator air chamber with an atmosphere, and positioning a dryer within the air path, wherein the dryer is configured to decrease humidity of air within the air path during ejection of ink from the printhead.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. have been simplified and are drawn to facilitate understanding of the present teachings rather than to maintain strict structural accuracy, detail, and scale.

DETAILED DESCRIPTION

Reference will now be made in detail to exemplary embodiments of the present teachings, examples of which are illustrated in the accompanying drawings. Wherever possible, the same reference numbers will be used throughout the drawings to refer to the same or like parts.

As used herein, unless otherwise specified, the word "printer" encompasses any apparatus that performs a print outputting function for any purpose, such as a digital copier, bookmaking machine, facsimile machine, a multi-function machine, ink-jet printer, electrostatographic device, etc.

As printheads continue to decrease in size, the scale of the electrostatic actuators also decreases. To improve electrostatic actuator operation and decrease the amount of power required to generate an electric field sufficient to flex the electrostatic actuator, a gap between the actuator membrane and the actuator electrode becomes small. For example, printheads having a gap between a surface of the actuator membrane and the actuator electrode as small as about 0.18 μm have been developed. As small air gaps, atmospheric conditions such as relative humidity have a greater effect on the efficient operation of the electrostatic actuators. For example, electrostatic actuators that operate sufficiently in conditions of low humidity may function poorly in conditions of high humidity.

As described below, an embodiment of the present teachings may include a dryer for decreasing the humidity of air that flows through a channel that vents each printhead electrostatic actuator to the atmosphere. In an embodiment, the dryer may be a heater that heats the air around one or more vent openings that lead to the plurality of air chambers between the membrane and the substrate assembly. In another embodiment, the dryer may be a chemical desiccant that absorbs moisture from the air around a vent opening. In an embodiment, the dryer may include both a heater and a chemical desiccant.

Figure 1:
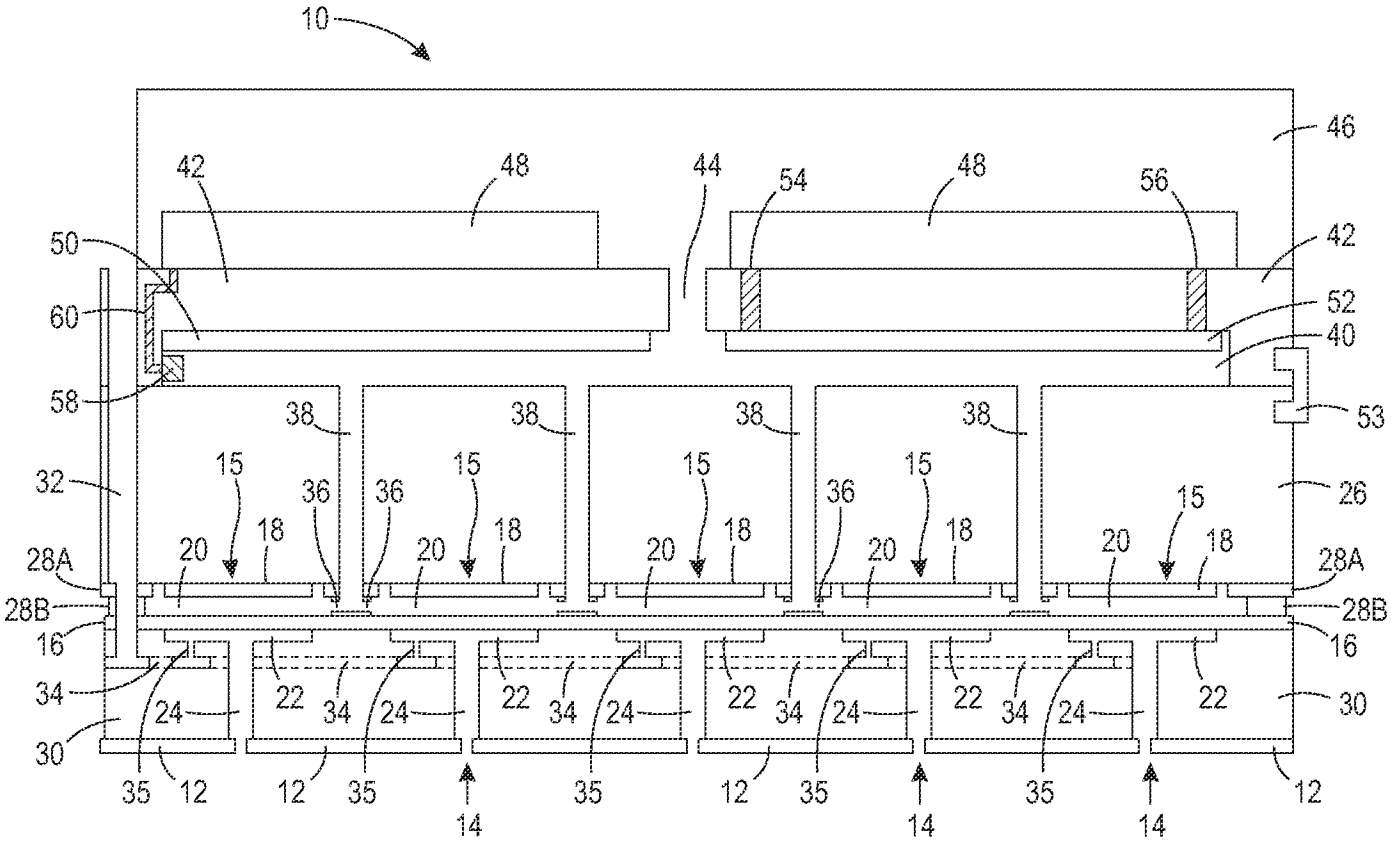
FIG. 1 is a cross section depicting a portion of an electrostatic printhead in accordance with an embodiment of the present teachings including a plurality of electrostatic actuators.
Figure 2:
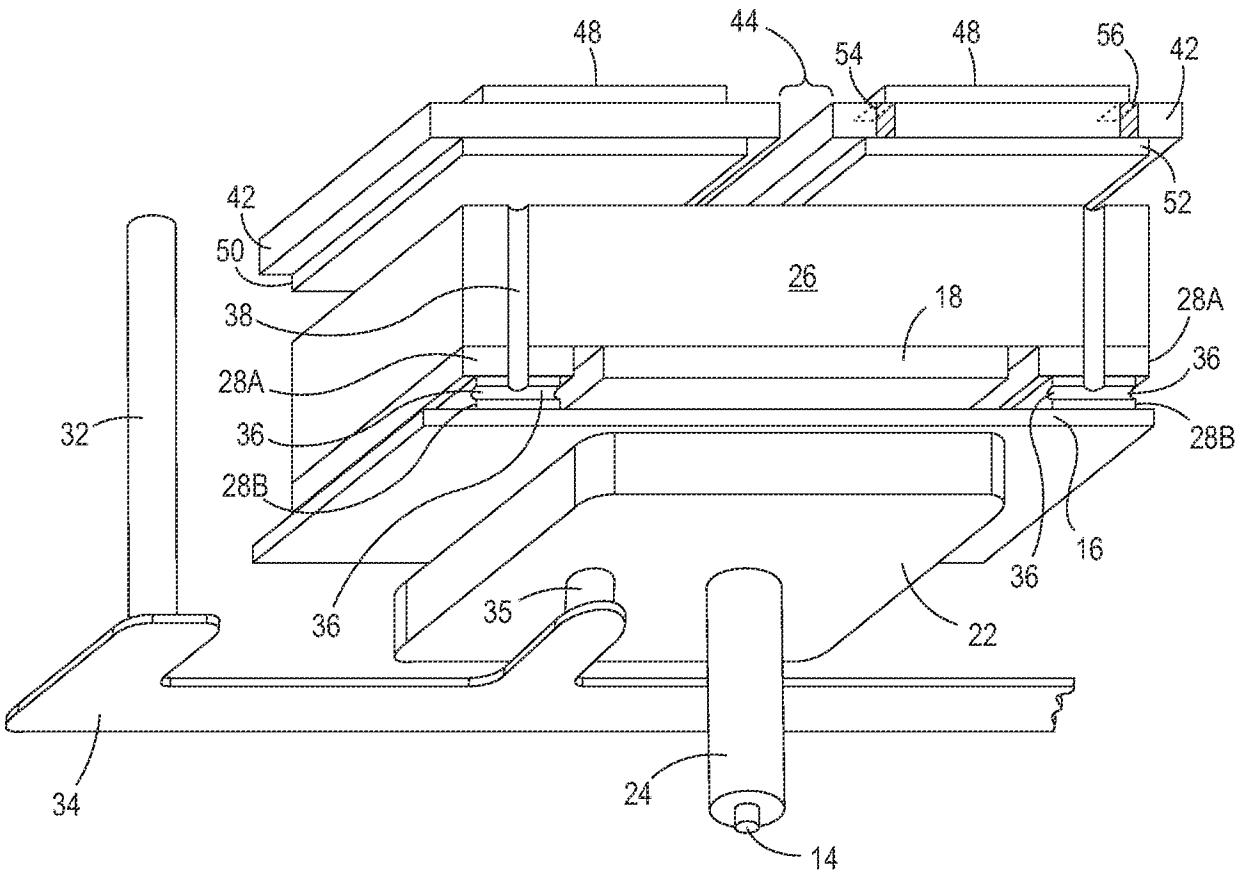
FIG. 2 is a perspective depiction of a portion of an electrostatic printhead in accordance with the present teachings.

FIG. 1 is a cross section depicting an embodiment of the present teachings, and FIG. 2 is a perspective depiction of a portion of the FIG. 1 embodiment, with similar structures being similarly numbered. FIG. 1 depicts a portion of a printhead 10 including an aperture plate 12 including a plurality of nozzles (i.e., apertures, nozzle openings) 14, and a plurality of electrostatic actuators 15. Each electrostatic actuator 15 may include a portion of a flexible membrane or diaphragm 16, an actuator electrode 18, a vented actuator air chamber 20, an ink chamber 22 interposed between the membrane 16 and the aperture plate 12, and an ink outlet 24 that leads from the ink chamber 22 to the nozzle 14. In this embodiment, the membrane 16 is interposed between the actuator air chamber 20 and the ink chamber 22. The actuator electrode 18 may be within the actuator air chamber 20 and/or exposed to air within the actuator air chamber 20 as depicted.

In an embodiment, the actuator electrodes 18 may be formed on a semiconductor substrate assembly 26 by providing a conductive layer that is etched to form the actuator electrodes 18. Bonding features 28 formed from a portion 28A of the conductive layer that also forms the actuator electrodes 18 and a dielectric layer 28B, may be used to bond the semiconductor substrate assembly 26 to the membrane 16.

Ink may be routed from an ink supply (not individually depicted for simplicity), through a vertical ink inlet 32 that extends through both the semiconductor substrate assembly 26 and the bonding features 28 as depicted, through an opening within the membrane 16, and into a jet stack subassembly 30 that may include a plurality of laminated functional layers (not individually depicted for simplicity). Ink may be routed from an ink supply (not individually depicted for simplicity) to the vertical inlet 32, to each nozzle 14 for each actuator 15 through an ink path or ink "bus." The ink path for a given actuator may lead from the vertical inlet 32, to a horizontal ink channel 34, to an ink inlet 35, to an ink chamber 22, to an ink outlet 24, then out through a nozzle 14 upon activation of an actuator 15. Using one of these ink paths, ink may be routed laterally through the ink jet stack subassembly 30 from the vertical inlet 32 to each nozzle 14. Each row and/or column of the array of actuators 15 may include a horizontal ink channel 34 that feeds ink to a plurality of actuators 15 as depicted. See the perspective depiction of FIG. 2 for additional detail. It will be understood that FIGS. 1 and 2 are schematic depictions, and a printhead may include additional features not depicted for simplicity, while depicted structures may be removed or modified.

In an embodiment, each actuator air chamber 20 may be exposed to the atmosphere through lateral openings 36 that extend through the bonding features 28 and vertical openings 38 that extend through the bonding features 28 and the semiconductor substrate assembly 26. The lateral openings 36 may interconnect the air chambers 20 of each actuator 15 in a row and/or column as depicted. The vertical openings 38 may open into a reservoir air chamber 40, for example, that is provided by a recess within a base 42 that is physically attached to the semiconductor substrate assembly 26. The base 42 may further include a vent 44 that opens into an electronics enclosure 46 that includes drive and control electronics 48 for the actuator array. Each actuator air chamber 20 may thus be vented to the atmosphere through an air path that includes the lateral openings 36 in the bonding structures 28, the vertical openings 38 through the bonding structures 28 and the semiconductor substrate assembly 26, the reservoir air chamber 40, and the vent 44. While FIG. 1 depicts five actuators 15 in the actuator array, it will be understood that an actuator array may include a grid of hundreds or thousands of actuators. Further, while the FIGS. depict one possible printhead configuration, it will be understood that a printhead in accordance with an embodiment of the present teachings may include an arrangement other than the exemplary, non-limiting embodiment depicted.

Actuators that are open to the atmosphere may be affected by the conditions of environmental air. For example, vented actuators may function sufficiently during periods of low relative humidity and poorly during periods of high relative humidity, particularly as the gap between the actuator electrodes and the actuator membrane decreases with smaller scale devices. Further, as input voltage to the electrodes decreases to produce lower power devices, relative humidity more greatly affects actuator operation.

The device of FIGS. 1 and 2 therefore includes one or more dryers, for example in the air path between the atmosphere and the actuator air chambers 20. The dryer may be positioned near the vent 44 to condition the air as it enters the vent 44. Other dryer locations are contemplated, as are various dryer types. FIGS. 1 and 2 depict a first dryer type 50, for example a desiccant, and a second dryer type 52, for example a resistive heater. While both types of dryers 50, 52 are depicted, it will be understood that a printhead may include only one dryer type, or a printhead may include both dryer types or other dryer types.

In FIGS. 1 and 2, the desiccant is physically connected to a surface of the base 42, but the desiccant 50 may be positioned at other locations in fluid communication with the air path between the atmosphere and the actuator air chambers 20. The desiccant 50 may remove environmental humidity from air entering the reservoir air chamber 40, thereby drying and lowering the humidity of the air. The desiccant 50 may be located at either or both sides of the vent 44, and may be located at another location within the reservoir air chamber 40, for example physically connected to the semiconductor substrate assembly 26. In an embodiment, the desiccant may include a chemical desiccant, for example one or more of a silica gel, activated charcoal, calcium sulfate, or calcium chloride. In an embodiment, the desiccant 50 may be removably mounted to the printhead within the reservoir air chamber 40, such that replacement of an exhausted desiccant 50 may be performed during a maintenance procedure. For example, access to the desiccant 50 within the reservoir air chamber 40 may be performed by removing the base 42 from the semiconductor substrate assembly 26 using a mounting system including one or more pins, posts, clips, etc. 53 that removably attaches the base 42 to the semiconductor substrate assembly 26.

In FIGS. 1 and 2, the heater 52 is physically connected to a surface of the base 42, but the heater 52 may be positioned at other locations in fluid communication with the air path between the atmosphere and the actuator air chambers 20. The heater 52 may be electrically coupled to power contacts 54 and ground contacts 56 that are also electrically coupled to the circuitry 48 within the electronics enclosure 48. The heater 52, for example a resistive heater formed using one or more conductive traces that serpentine or otherwise extend across the printhead, may therefore receive power from the circuitry 48 to remove environmental humidity from air entering the reservoir air chamber 40, thereby drying and lowering the humidity of the air. The heater 52 may be located at either or both sides of the vent 44, and may be located at another location within the reservoir air chamber 40, for example physically connected to the semiconductor substrate assembly 26.

In an embodiment, a printhead may include both a desiccant 50 and a heater 52 as depicted. Because the heater 52 requires additional power, the desiccant 50 may provide passive drying of the air during normal printhead operation to provide a lower power operation. During a maintenance cycle, the heater 52 may be powered to heat the air within the reservoir air chamber 40, which heats, dries, and thereby recharges the desiccant 50. It is also contemplated that the heater 52 and desiccant may both be continuously used during normal printhead operation to provide improved humidity reduction of air entering the reservoir air chamber 40.

In an embodiment, a sensor 58, for example within the reservoir air chamber 40, may be used to monitor or estimate the humidity of air within the printhead 10. The sensor 58, for example a temperature or humidity sensor, may be electrically coupled through connection 60 with circuitry 48 that powers and controls the sensor 58 and the heater 52. In normal operation during periods of lower humidity, the heater 52 is not powered to provide low power printhead operation. Once the detected humidity of air within the printhead increases and reaches a setpoint, circuitry 48 powers on the heater 52 to heat and dry the air within the reservoir air chamber 40. Once the detected humidity of air within the printhead decreases and reaches a setpoint, circuitry 48 powers off the heater 52 to conserve energy.

In another embodiment, rather than using a sensor 58, the heater 52 may be powered on (i.e., activated) and powered off (i.e., deactivated) at alternating intervals of time during normal operation of, and ejection of ink by, the printhead to provide active heating and humidity control of air within the printhead. While additional power may be used compared to an embodiment that uses a sensor 58 to determine humidity and power the heater 52 only when needed, timed operation of the heater 52 does not require a sensor 58 and may therefore have reduced cost compared to a sensor embodiment.

It will be understood that the present teachings are not limited to the embodiment shown in the FIGS., which depict one structural implementation of the present teachings. Other structural arrangements would function sufficiently while providing an embodiment of the present teachings as claimed. In an embodiment, vertical openings 38 that equalize pressure between each actuator air chamber 20 and the atmosphere may be located at other printhead locations. Routing of vertical openings may include horizontal, vertical, and/or oblique paths through the printhead, and may extend through dielectric, conductive, and/or semiconductive layers. Further, dryers 50, 52 may be positioned at other locations within the air path of the venting system while providing sufficient humidity reduction of air within the air path, particularly the air within each actuator air chamber 20.

Thus, an embodiment of the present teachings may provide an ink jet printhead having a venting system that provides equalization of pressures within actuator air chambers 20 with the atmosphere. The venting system may be provided by an air path that extends from the actuator air chambers 20 through a lateral opening 36 in a bonding structure 28, through a vertical opening 38 in the bonding feature 28 and a semiconductor substrate assembly 26 that opens into a reservoir air chamber 40 in a base 42, and through a vent 44 within the base 42. A dryer 50, 52 may be provided that dries air within the air path. The dryer may include a passive dryer such as a desiccant 50, an active dryer such as a resistive heater 52, or both a passive dryer 50 and an active dryer 52. A sensor 58 may be used to monitor or measure temperature of the air so that an estimation of humidity of air within the printhead 10 may be made, or the sensor 58 may measure the humidity within the printhead directly. The sensor 58 may allow selective activation of the heater 52 during periods of higher humidity and selective deactivation of the heater 52 during periods of lower humidity, thereby reducing power usage by the printhead 10. In another embodiment, the heater may be powered on and off according to a timed power cycle. If both a desiccant 50 and a heater 52 are used, the heater 52 may be used to dry and recharge the desiccant 50, so that heater 52 use and power consumption are reduced compared to an embodiment that provides constant power to the heater 52. A heater, for example formed using one or more traces, may be formed using microelectronic methods, for example during the formation of other printhead structures, and thus provides a low cost, low power heater.

Figure 3:
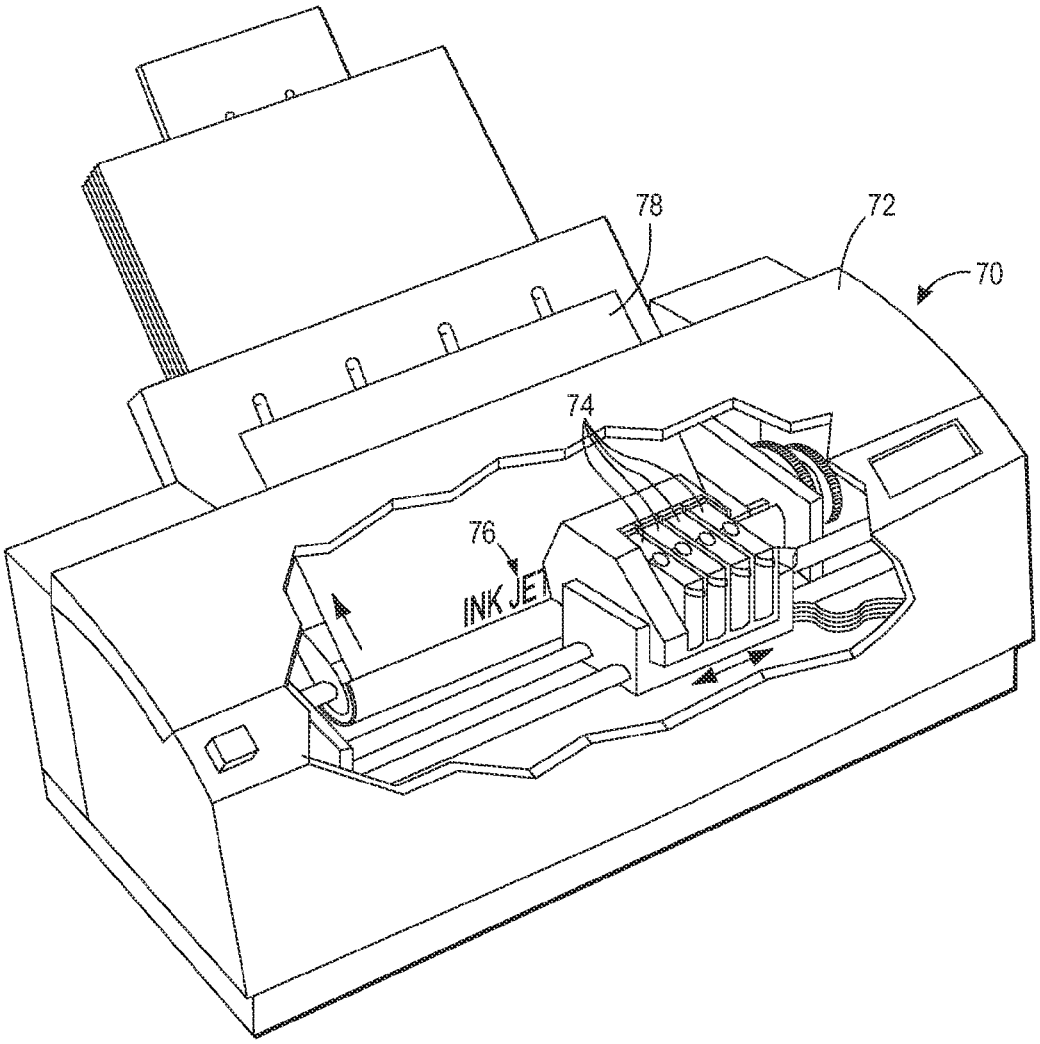
FIG. 3 is a perspective depiction of an ink jet printer including one or more printheads in accordance with an embodiment of the present teachings.

FIG. 3 depicts a printer 70 including a printer housing 72 into which at least one printhead 74 including an embodiment of the present teachings has been installed. The housing 72 may encase the printhead 74. During operation, ink 76 is ejected from one or more printheads 74. The printhead 74 is operated in accordance with digital instructions to create a desired image on a print medium 78 such as a paper sheet, plastic, etc. The printhead 74 may move back and forth relative to the print medium 78 in a scanning motion to generate the printed image swath by swath. Alternately, the printhead 74 may be held fixed and the print medium 78 moved relative to it, creating an image as wide as the printhead 74 in a single pass. The printhead 74 can be narrower than, or as wide as, the print medium 78. In another embodiment, the printhead 74 can print to an intermediate surface such as a rotating drum, belt, or drelt (not depicted for simplicity) for subsequent transfer to a print medium.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. A printhead, comprising:

a plurality of actuators, wherein each actuator comprises:

an actuator air chamber;

an actuator electrode;

a membrane configured to flex toward the electrode during activation of the electrode; and an actuator ink chamber, wherein the membrane is interposed between the actuator air chamber and the actuator ink chamber;

a venting system comprising an air path that vents each actuator air chamber; and a dryer positioned within the air path, wherein the dryer is configured to decrease humidity of air within the air path.

2. The printhead of claim 1, wherein the dryer comprises a resistive heater configured to be powered and to provide an active dryer.

3. The printhead of claim 2, wherein the resistive heater is configured to activate and to deactivate during alternating intervals of time.

4. The printhead of claim 2, further comprising a sensor configured to monitor the humidity of the air within the air path, wherein the resistive heater is configured to activate and to deactivate in response to the humidity of the air as monitored by the sensor.

5. The printhead of claim 2, wherein the resistive heater is configured to be continuously powered during operation of the printhead.

6. The printhead of claim 2, wherein the dryer further comprises a chemical desiccant positioned within the air path.

7. The printhead of claim 6, wherein the resistive heater is configured to be powered only during a maintenance cycle that dries and refreshes the chemical desiccant.

8. The printhead of claim 1, wherein the dryer comprises a chemical desiccant configured to provide a passive dryer.

9. The printhead of claim 8, wherein the chemical desiccant comprises at least one of a silica gel, activated charcoal, calcium sulfate, or calcium chloride.

10. The printhead of claim 8, wherein the desiccant is removably attached to the printhead and configured to be removed from the printhead during a maintenance procedure.

11. The printhead of claim 1, further comprising:

a semiconductor substrate assembly, wherein the plurality of actuators are formed on the semiconductor substrate assembly; and a plurality of bonding structures that physically attach the semiconductor substrate assembly to the membrane, wherein the air path of the venting system extends laterally through the plurality of bonding structures and vertically through the semiconductor substrate assembly to vent each actuator air chamber to an atmosphere.

12. The printhead of claim 11, further comprising:

a base attached to the semiconductor substrate assembly, wherein the base comprises a recess therein that provides a reservoir air chamber, wherein the air path of the venting system comprises the reservoir air chamber; and the dryer is within the reservoir air chamber.

13. A printer, comprising:

a printhead, comprising:

a plurality of actuators, wherein each actuator comprises:

an actuator air chamber;

an actuator electrode;

a membrane configured to flex toward the electrode during activation of the electrode; and an actuator ink chamber, wherein the membrane is interposed between the actuator air chamber and the actuator ink chamber;

a venting system comprising an air path that vents each actuator air chamber;

a dryer positioned within the air path, wherein the dryer is configured to decrease humidity of air within the air path; and a printer housing that encases the printhead.

14. The printer of claim 13, wherein the dryer comprises a resistive heater configured to be powered and to provide an active dryer.

15. The printer of claim 14, wherein the resistive heater is configured to activate and to deactivate during alternating periods of time.

16. The printer of claim 14, further comprising a sensor configured to measure at least one of the humidity of the air within the air path and a temperature of the air within the air path, wherein the resistive heater is configured to activate and to deactivate in response to the measurement by the sensor.

17. The printer of claim 14, wherein the dryer further comprises a chemical desiccant positioned within the air path.

18. The printer of claim 17, wherein the desiccant is removably attached to the printhead and configured to be removed from the printhead during a maintenance procedure.

19. The printer of claim 13, further comprising:

a semiconductor substrate assembly, wherein the plurality of actuators are formed on the semiconductor substrate assembly; and a plurality of bonding structures that physically attach the semiconductor substrate assembly to the membrane, wherein the air path of the venting system extends laterally through the plurality of bonding structures and vertically through the semiconductor substrate assembly to vent each actuator air chamber to an atmosphere.

20. A method for forming a printhead, comprising:

forming a plurality of actuators, wherein each actuator comprises:

an actuator air chamber;

an actuator electrode;

a membrane configured to flex toward the electrode during activation of the electrode; and an actuator ink chamber, wherein the membrane is interposed between the actuator air chamber and the actuator ink chamber;

forming a venting system comprising an air path that vents each actuator air chamber; and positioning a dryer within the air path, wherein the dryer is configured to decrease humidity of air within the air path of the printhead.

* * * * *